US008800737B2

(12) United States Patent
Fair et al.

(10) Patent No.: US 8,800,737 B2
(45) Date of Patent: Aug. 12, 2014

(54) LUGGAGE WITH A CRUSH PROOF COMPARTMENT

(75) Inventors: Paul Fair, Denver, CO (US); James A. Bergh, Boulder, CO (US)

(73) Assignee: Thule Organization Solutions, Inc., Longmont, CO (US)

( * ) Notice: Subject to any disclaimer, the term of this patent is extended or adjusted under 35 U.S.C. 154(b) by 562 days.

(21) Appl. No.: 12/956,347

(22) Filed: Nov. 30, 2010

(65) Prior Publication Data

US 2011/0127132 A1 Jun. 2, 2011

Related U.S. Application Data

(60) Provisional application No. 61/265,212, filed on Nov. 30, 2009.

(51) Int. Cl.
*A45C 3/00* (2006.01)

(52) U.S. Cl.
USPC ..... 190/110; 190/109; 150/112; 150/113

(58) Field of Classification Search
USPC ..... 190/109–111; 150/104, 113, 112
See application file for complete search history.

(56) References Cited

U.S. PATENT DOCUMENTS 1,861,948 A * 6/1932 Barkdoll ..... 206/315.9
4,236,615 A * 12/1980 Ginat ..... 190/111
4,629,040 A 12/1986 Jones
4,767,039 A * 8/1988 Jacober ..... 224/153
5,197,580 A 3/1993 Berman et al.
5,265,719 A * 11/1993 Wand ..... 206/223
5,267,679 A * 12/1993 Kamaya et al. ..... 224/583
6,213,268 B1 * 4/2001 Dancyger ..... 190/110
6,446,688 B1 9/2002 Sutton
6,523,653 B2 * 2/2003 Roegner ..... 190/109
6,612,472 B1 * 9/2003 Zakarin ..... 224/652
6,863,201 B2 * 3/2005 Esqueda ..... 224/576
2003/0024960 A1 * 2/2003 Greenstein et al. ..... 224/153
2003/0136623 A1 7/2003 Renz et al.
2006/0006036 A1 1/2006 Godshaw et al.
2006/0113203 A1 * 6/2006 Daley ..... 206/320
2008/0164265 A1 * 7/2008 Conforti ..... 220/592.2
2010/0276436 A1 * 11/2010 Liu ..... 220/735

OTHER PUBLICATIONS

Extended European Search Report for European Patent Application No. 10192913.1, dated Apr. 14, 2011 7 pages.
Official Action for China Patent Application No. 201020658276.6, dated May 12, 2011 2 pages.
Notification of Grant of Patent Right for China Patent Application No. 201020658276.6, dated Aug. 17, 2011 2 pages.

* cited by examiner

*Primary Examiner* — Tri Mai
(74) *Attorney, Agent, or Firm* — Sheridan Ross P.C.

(57) ABSTRACT

A carrying case with a first enclosure ad at least one additional enclosure which includes a substantially rigid, and selectively removable protective compartment which must be oriented at a predetermined position for both insertion and selective removal. The selectively removable protective compartment may be adapted for isolated and secure storing of delicate or fragile items.

7 Claims, 6 Drawing Sheets

LUGGAGE WITH A CRUSH PROOF COMPARTMENT

This application claims priority to U.S. Provisional Patent Application 61/265,212, filed Nov. 30, 2009, which is hereby incorporated by reference in its entirety.

FIELD OF THE INVENTION

The present invention relates generally to an apparatus that offers the flexibility and convenience of a conventional soft luggage piece with an additional rigid storage compartment. More specifically, the present invention relates to a soft luggage piece with a removable insert that may be optionally employed to protect contents such as glasses, goggles, electronics, and other valuable or delicate items.

BACKGROUND OF THE INVENTION

It is currently known in the art to provide a substantially rigid compartment or shell as a luggage device to protect contents to be stored or carried. There exists a long felt need, however, to provide a luggage unit that offers the convenience of a lightweight and collapsible soft luggage bag while still providing optional protection for smaller items such as glasses, ski goggles, electronic devices, and the like. For example, when soft shell luggage is desired for travel and transportation where the luggage may be subjected to impact or compression, a relatively small portion of the luggage that provides protection from impact and/or compression forces is desirable. Furthermore, as rigid compartments are known to typically occupy usable space or increase the size of a luggage device, there further exists a need to provide a substantially rigid portion that provides impact and crush protection and that is also selectively removable. Where selectively removable devices are utilized, it is thus desirable to provide a device and system that allows for removal and reinsertion of a rigid device in such a way that it is secure. For example, it may be desirable to provide a device that may be quickly removed from the luggage without the use of tools or additional parts, yet is still securely attached so as to reduce, minimize, or eliminate the risks of a rigid compartment becoming unintentionally dislodged. Additionally, protection from impact and compression from objects co-housed within the luggage is often desirable.

U.S. Pat. No. 4,629,040 to Jones discloses a rigid insert provided in a soft luggage shell that is removably held in place by a twistable retainer ring and is hereby incorporated by reference in its entirety. However, Jones fails to teach a device wherein the rigid insert occupies only a portion of the soft luggage shell that isolates certain items in a rigid surrounding and thereby protects the items from impact from other items in the luggage as well as impact and compression from outside forces. Accordingly, Jones fails to teach novel aspects of the present invention.

U.S. Pat. No. 5,197,580 to Berman et al., which is hereby incorporated by reference in its entirety, discloses a collapsible article of luggage in which a plurality of reinforcing panels or inserts allow the luggage to assume either a rigid or collapsible form. Berman et al. fail to teach a rigid pocket or compartment that is capable of storing objects in relative isolation from other luggage contents and that can be selectively removed.

U.S. Pat. No. 6,446,688 to Sutton, hereby incorporated by reference in its entirety, discloses a carry bag with a pouch insert and magnetic fasteners so that purse or bag contents may be easily transferred to another bag. Sutton does not teach an insert or compartment suitable for protecting contents from forces that may be applied by additional bag or luggage contents or from the outside environment. Accordingly, Sutton fails to teach novel aspects of the present invention.

Known devices also fail to adequately provide a device wherein a rigid device is adapted for insertion and removal to and from various luggage devices, wherein the device is securely affixed or placed within the luggage device and without the need to utilize tools, etc. For example, placing a known hard-shell case such as a glasses case within a bag results in a situation whereby the case is free to move around an inner volume of the bag and poses a risk of loss as the case is in an unsecured state.

Therefore, there has been a long-felt and unmet need to provide a soft luggage unit that further includes a rigid removable compartment capable of storing, protecting, and isolating luggage contents.

SUMMARY OF THE INVENTION

It is thus one aspect of the present invention to provide a luggage unit with a selectively removable rigid compartment for protective storage and isolation of items. In one embodiment, the rigid compartment comprises a hard shell which may be disposed within a region of the luggage unit which further comprises a rigid cover or flap for containing the rigid compartment and/or items to be stored.

It is another aspect of the present invention to provide a luggage unit with a selectively removable compartment wherein the selectively removable compartment does not increase the total volume of the luggage unit or substantially reduce the usable interior volume of the luggage unit after the removable component is removed from a receiving portion.

It is yet another aspect of the present invention to provide a substantially soft luggage unit that may operate as a traditional soft luggage unit (e.g. duffle bag) when the selectively removable compartment is not employed.

It is yet another embodiment of the present invention to provide a device that allows a user to insert and remove a rigid compartment with relative ease and quickness while still providing secure attachment means so that the risks of loss or displacement of the rigid compartment are reduced.

In various embodiments, the present invention comprises an insertable rigid compartment which is dimensioned to be securely placed within a flexible compartment of a bag or luggage device, the compartment specifically adapted to receive the rigid compartment. For example, in one embodiment, a rigid insert or case is provided with a length, width and depth, wherein the depth of the insert is the only dimension capable of being inserted into an initial opening or perimeter edge of the compartment adapted to receive the insert. In other words, the depth of the insert is less than the width of the receiving portion. Thus, in one embodiment, the insert must be placed in the compartment by positioning the insert in a manner that is offset or obtuse from an intended final position and rotated into a secure position until it is to be selectively removed via similar procedures. While in place, the insert is impeded from inadvertent removal by the length or width of the insert being larger than the length or width of at least a perimeter edge of the receiving portion. Further, the flexible compartment or "receiving portion" in one embodiment is comprised of a stretchable material which biases the rigid insert upward against the edge of the perimeter opening to the receiving portion.

As used herein, "obtuse" refers to an orientation of a rigid insert, wherein a planar opening portion of the insert, and therefore the insert itself, is generally offset with respect to a plane of the receiving portion and/or perimeter edge. It will be recognized that the offset may be with respect to any of the three axes of the insert or combinations thereof.

In an alternative embodiment, the present invention comprises an insert adapted to be placed within a luggage compartment, wherein the insert comprises an at least partially deformable material. For example, in one embodiment, an insert is provided comprising an elastically deformable material, such as a rubber, which is adapted to elastically deform under specific user-applied forces yet generally provide protection for delicate items (e.g. glasses) when the insert is subject to various forces. The elastically deformable insert may be temporarily deformed by a user for the purposes of inserting the insert into a compartment, wherein the insert elastically restores to an original position adapted for storing and protecting items.

In various embodiments, the present invention comprises a luggage item with a selectively insertable and substantially rigid insert wherein the substantially rigid insert is at least partially affixed to the luggage item through one or more fastening devices. Fastening devices of the present invention include, but not are not limited to zippers, snaps, Velcro, buttons, magnets, cord locks, and similar devices. For example, in one embodiment, a substantially rigid insert is secured within a portion of a luggage item by zippering an edge portion of the insert to one or more zippers disposed on the luggage item.

In one embodiment, the present invention comprises a substantially rigid insert which is permanently interconnected to a portion of a luggage item. For example, in a particular embodiment, a luggage item is provided having a substantially rigid insert disposed therein, the interior and contents of the insert only being accessible from an exterior of the luggage item. The insert may be securely affixed to a portion of the luggage item, such as through stitching or sewing a portion of the insert to the luggage item. Access is provided by a hinged cover, preferably also constructed of a substantially rigid material and being selectively closable through the use of one or more zippers. In an alternative embodiment, a similar arrangement is provided wherein access to the interior and contents of the insert is achieved through an interior portion of the luggage item.

Substantially rigid inserts, hinged covers, etc. of the present invention are preferably constructed of one or more rigid materials including, but not limited to polypropylene, polyethylene, and various similar materials and polymers. In a preferred embodiment, at least an interior portion of an insert is provided with a shock absorbing material, such as EVA foam and optionally covered or coated with a non-abrasive textile.

In one embodiment, a luggage item comprises a compartment for receiving at least one substantially rigid insert, the compartment comprising a perimeter edge, lip or initial portion through which the insert is received and a portion of elastically deformable material generally disposed interior of the perimeter edge for receiving and stabilizing an insert. For example, in one embodiment, a luggage item is provided comprising a lip or initial portion defining an aperture and a stretchable product, such as lycra, extending inwardly from the initial portion. The stretchable or elastic product is designed to expand as necessary and receive a substantially rigid insert. Similarly, when the use and/or placement of an insert are not desired, the compartment comprising an elastically deformable material provides a non-rigid, flexible structure which collapses, and hence does not occupy a substantial internal volume of the luggage device.

In an alternate embodiment, a luggage item is provided having an aperture portion adapted for receiving a lip or perimeter edge of a removable insert, the outer portion of the removable insert being generally exposed to an internal volume and potential contents of the luggage item. Thus, in at least one embodiment, the present invention does not comprise a pouch or compartment for receiving an insert. Rather, the rigid structure of the insert and connection with a lip or initial portion of the luggage item defines a space within which items may be stored and/or secured.

In yet another embodiment, the present invention comprises a self-contained or "take-away" case which does not require combination with a luggage item for use. For example, a substantially rigid insert is provided with an attached lid or closable portion such that the insert may be positioned within a portion of a luggage item, or may function solely as a rigid case or compartment without combination with the luggage item.

In various embodiments of the present invention, a carrying bag for storing articles is provided, the carrying bag comprising a substantially rigid insert and a receiving portion for the substantially rigid insert. In one embodiment, the receiving portion is at least partially disposed within an internal volume of the carrying bag and is adapted for selectively receiving the substantially rigid insert. The receiving portion may comprise an elastic material, such as spandex, lycra, cotton, rubber, etc., extending into an inner volume of the carrying bag in at least one state. Optionally, a substantially rigid hinged cover for selectively sealing the receiving portion is provided, the hinged cover being attached to the carrying bag and adapted for closing or sealing a receiving portion, whether or not the rigid insert is disposed therein.

In one embodiment, the substantially rigid insert or case has a width greater than a defined width of a perimeter edge of the receiving portion, a defined length greater than a length of a perimeter edge of the receiving portion, and at least one dimension, e.g. a depth less than a defined width of the receiving portion. Thus, the substantially rigid insert may be secured within the receiving portion by inserting the rigid compartment at an angle obtuse to a planar portion of a receiving portion, and exerting a rotational and linear force on the rigid compartment.

In a particular embodiment, a receiving portion and insert contained therein is only accessible from the exterior of the carrying bag. In an alternative embodiment, the receiving portion and contents thereof are accessible through an interior portion of the carrying bag.

One of ordinary skill in the art will recognize various means and/or devices by which the rigid insert may be secured within the receiving portion, including, but not limited to zippers, Velcro, magnets, and a pliable lip.

It is contemplated that the receiving portion and/or insert comprise a relatively small usable volume as compared with the volume of the carrying bag. For example, in one embodiment, an insert and receiving portion is provided which is no greater than ¼ of the volume of the bag generally. Thus, in various embodiments, the insert and receiving portion are adapted for carrying small or delicate items such as glasses, goggles, electronics, etc.

In one embodiment, a substantially rigid insert of the present invention comprises a generally rectilinear device comprising at least five walls. As used herein, generally rectilinear refers to an object having generally distinct wall structures and a defined interior volume, but is not limited to a device with sidewalls or walls at right angles to one another. Indeed, it is contemplated that the insert may have round or curved walls and, in alternative embodiments, comprises a generally hemispherical shape. In one embodiment, the present invention comprises a generally rectilinear object having six walls, at least one of the walls being hingedly connected to a remainder of the insert and sealable or closeable through various devices, such as zippers, snaps, Velcro, etc.

As used herein, means for securing the substantially rigid insert within the receiving portion refers to any number of known securing devices including, but not limited to magnets, Velcro, zippers, snaps, cords, elastic cords, cord locks, flaps, etc.

In various embodiments, a carrying bag with a removable accessory case or rigid insert for storing fragile articles is provided, the carrying bag further comprising an enclosure defined by at least a bottom portion and opposing side walls. As used herein, a bottom portion of an enclosure refers to a portion disposed generally opposite an entrance or perimeter edge portion of the enclosure, regardless of how the enclosure is oriented with respect to the carrying bag. One of ordinary skill in the art will recognize that features of the present invention may be disposed in any number of orientations with respect to a carrying bag. Thus, the terms bottom or lower used herein refer to an inner portion of the enclosure disposed opposite a receiving portion, the bottom portion and the perimeter opening having generally parallel planes. As used herein, a perimeter opening refers to a generally planar portion or aperture that comprises an area through which an insert or accessory case may be placed through a sidewall portion of a bag and thus contained, disposed, and/or secured within a receiving portion.

In one embodiment, a collapsible, stretchable receiving portion is provided at least partially disposed within said enclosure of said carrying bag with a substantially rigid case being selectively removable from the carrying bag and defined by at least a plurality of sidewalls to provide a protective space which is adapted to store a fragile article. The stretchable receiving portion in one embodiment provides a biasing force which secures the removable accessory case against a lower surface of the perimeter edge of the receiving portion, and thus prevents inadvertent removal thereof. The substantially rigid case may comprise at least one dimension that is larger than a corresponding dimension of a perimeter opening of the receiving portion, thus providing for a secure mating or fit of the removable accessory case within the receiving portion and inside the perimeter opening.

In one embodiment, the substantially rigid case is secured within the receiving portion by inserting the rigid compartment at an angle obtuse with respect to a planar portion of said perimeter opening, and exerting a rotational and linear force on the rigid compartment to provide securement. A cover may further be provided for selectively closing the receiving portion.

In various embodiments, a carrying bag for storing articles in two distinct compartments is provided. The carrying bag comprises a first enclosure defined by at least a bottom portion and a plurality of side walls and a second enclosure defined by a flexible, collapsible receiving portion which is disposed within the confines of the first enclosure and having a perimeter opening with an edge having a defined width and length.

In one embodiment, a substantially rigid insert that is removable from the carrying bag is provided wherein the rigid insert has at least one of a width greater than said width of said edge of said perimeter opening of the receiving portion, and a length longer than the length of said edge of said perimeter opening of the receiving portion. The substantially rigid insert is positioned within the flexible receiving portion by positioning the rigid insert at an obtuse angle with respect to the plane of the perimeter opening, and the insert is retained within said collapsible retaining portion by engaging a lower surface of the perimeter opening.

Thus, in various embodiments, a substantially rigid insert is provided having at least one dimension that is larger than a corresponding dimension of a perimeter opening of a receiving portion in which the insert may be housed. Accordingly, predetermined orientation and/or rotation of the insert are required in order to place the insert within the receiving portion and remove the insert from the receiving portion, thereby providing for secure containment of the insert when disposed within the receiving portion.

One of ordinary skill in the art will recognize that features and devices of the present invention are not limited to any particular type, size, or style of luggage item. Inserts and receiving portions as described herein may be employed in various different luggage items including, but not limited to duffle bags, laptop bags, camera bags, hand bags, attaché bags, brief cases, satchels, messenger bags, backpacks, waist packs, tote bags, rolling bags, etc. It will further be recognized that substantially rigid inserts of the present invention are not limited to those designed to carry any particular item. Indeed, inserts of the present invention may be sized and/or adapted to carry any number of items which an individual may wish to isolate or protect.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, the summary of the invention is neither intended nor should it be construed as being representative of the full extent and scope of the present invention. The present invention is set forth in various levels of detail in the summary of the invention, as well as, in the attached drawings and the detailed description of the invention and no limitation as to the scope of the present invention is intended to either the inclusion or non-inclusion of elements, components, etc. in this summary of the invention. Additional aspects of the present invention will become more readily apparent from the detailed description, particularly when taken together with the drawings.

Figure 1:
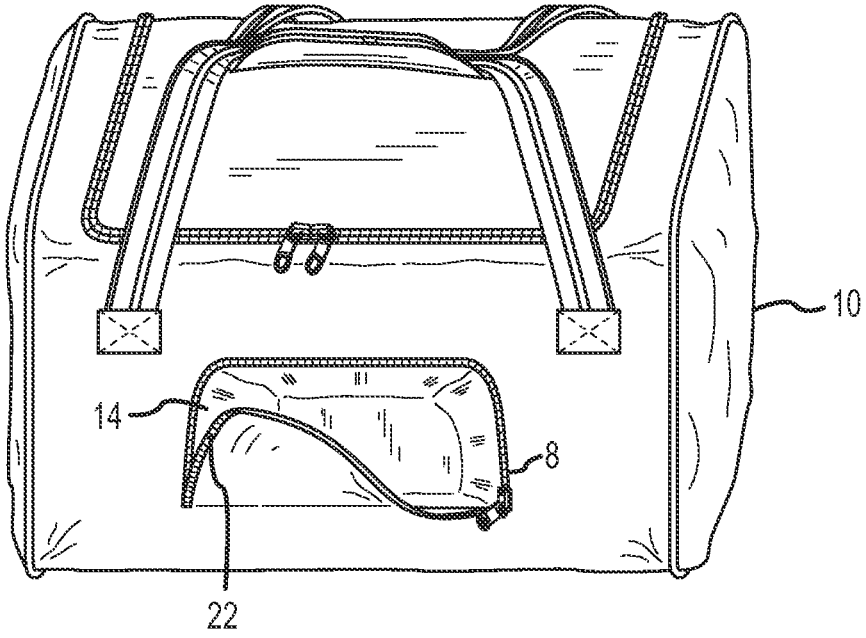
FIG. 1 is a front elevation view of a luggage unit with a substantially rigid removable compartment.

To assist in the understanding of the present invention the following list of components and associated numbering found in the drawings is provided herein:

| Component | # |
|---|---|
| Perimeter Edge | 8 |
| Luggage Unit | 10 |
| Rigid Compartment | 14 |
| Receiving Portion | 18 |
| Closure Means | 22 |
| Compartment | 26 |
| Direction Arrow | 30 |
| Rotational Arrow | 34 |

It should be understood that the drawings are not necessarily to scale. In certain instances, details that are not necessary for an understanding of the invention or that render other details difficult to perceive may have been omitted from these drawings. It should be understood, of course, that the invention is not limited to the particular embodiments illustrated in the drawings.

DETAILED DESCRIPTION

Figure 2:
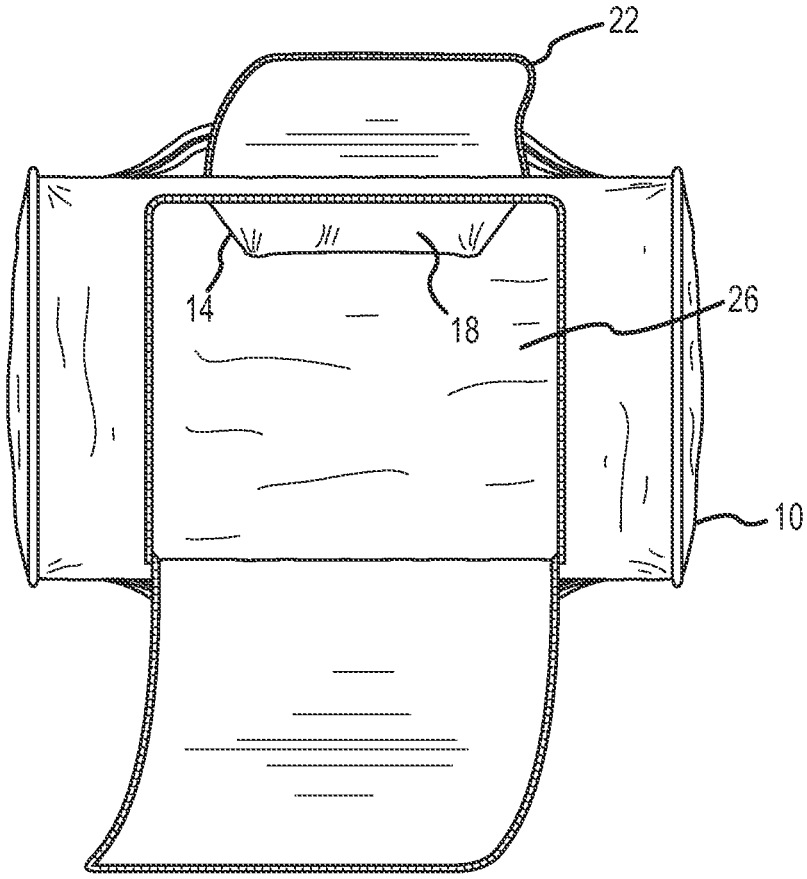
FIG. 2 is a top view of a luggage unit with a substantially rigid removable compartment.
Figure 3:
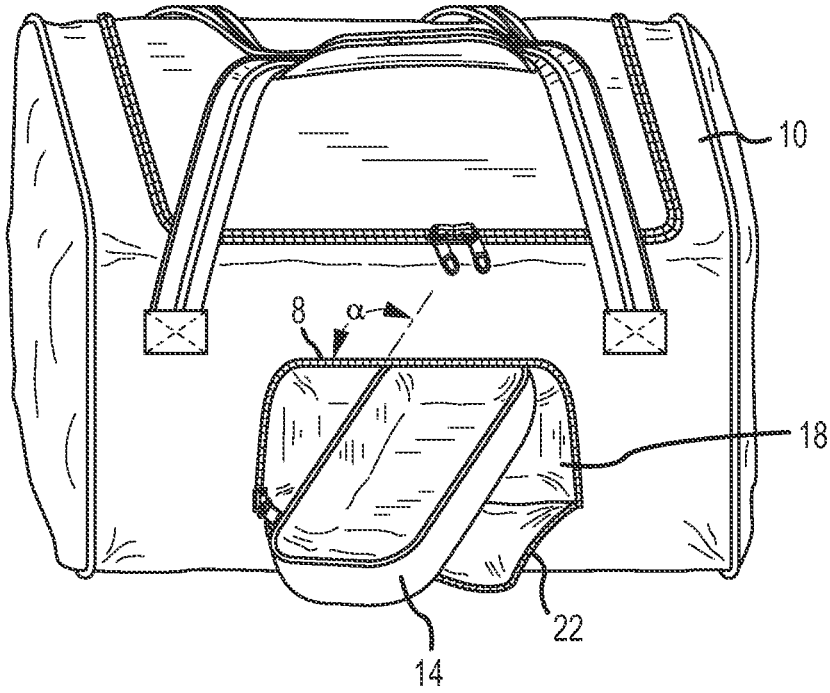
FIG. 3 is a perspective view of one embodiment of the present invention.

Referring now to FIGS. 1-3, a luggage unit 10 with a substantially rigid removable compartment or insert 14, a receiving area 18 for the substantially rigid insert, and a substantially rigid cover or closure means 22 is shown. The receiving portion 18 comprises a perimeter edge 8, the perimeter edge having a length and a width. As shown in FIG. 1, the length of the perimeter edge refers to a horizontal dimension and the width refers to a vertical dimension. However, one of ordinary skill in the art will recognize that the receiving area and corresponding perimeter edge may be oriented in any number of positions with respect to a luggage unit 10.

In one embodiment, luggage unit 10 is a generally soft or compressible bag, such as a "duffle" or "tote" bag with at least one compartment 26 for stowing items. One skilled in the art will appreciate that compartment 26 may house any number of items desired to be carried or transported by a user. It will further be appreciated that luggage units of this type may be made of any number of materials including, but not limited to nylon, canvas, cotton, leather, polyester or other similar materials and combinations thereof. Advantages of these devices, as will be recognized, include lightweight and compressibility or ease of storage when not in use. However, these devices suffer from disadvantages of having minimal impact resistance and objects disposed within these bags may be damaged upon dropping the bag or when other items impact or compress the bag.

Rigid insert 14 is provided as shown to allow for the protected storage of items within a generally soft bag. Rigid insert 14 may be disposed within a soft and flexible receiving portion 18. In one embodiment, the receiving portion 18 is comprised of a flexible material (e.g. spandex or other synthetic elastic material) capable of conforming to the dimensions of the rigid insert 14. Furthermore, receiving portion 18 is preferably constructed of a material with little structural integrity, thus preventing receiving portion 18 from maintaining a shape that may occupy a substantial portion of the interior volume of the compartment 26 when the rigid insert 14 is not used.

One skilled in the art will recognize that although receiving portion 18 is preferably intended to receive a rigid insert 14, it may also be used for stowage of items whether or not a rigid insert 14 is disposed within the receiving portion 18. Rigid insert 14 may be constructed of a lightweight material that resists deformation and fracture from externally applied forces. Those skilled in the art will recognize that various materials may be employed to achieve objectives of the present invention. By way of example only, polypropylene, high density polyethylene, ultra high molecular weight polyethylene, polyvinyl chloride (PVC), carbon fiber, steels, and rubbers are a few of the materials which may comprise the rigid compartment 14. Rigid insert 14 may be coated with a non-abrasive material, such as a textile or rubber, so as to further prevent damage to items stowed within.

The present invention further contemplates a receiving portion 18 that does not comprise a flexible pouch or interior portion. For example, a rigid insert 14 may be disposed within an aperture of the luggage unit 10 wherein the rigid insert 14 is held in place by a lip or edge portion of the aperture. When the rigid compartment is not disposed within the bag, a flap or cover 22 may be closed to seal the luggage unit 10. Furthermore, various alternative embodiments and equivalents are contemplated by the present invention, including providing a net or wireframe in place of receiving portion 18 and providing various fastening means such as Velcro®, a zipper, magnet(s), and/or snaps to affix the rigid compartment 14 to the luggage unit 10.

Referring now to FIG. 3, an embodiment of the present invention is shown wherein the geometries of a rigid insert 14 and corresponding receiving portion 18 are utilized to provide additional fixation of the rigid insert 14. As one object of the present invention is to securely stow and transport delicate or valuable items, it is desirable to provide means for ensuring that the rigid insert 14 will not be easily dislodged from the present invention 10. Accordingly, in one embodiment, rigid insert 14 is constructed with a width greater than a width of the perimeter edge or first portion of the receiving portion 18 and a depth less than a width of a first portion or perimeter edge of receiving portion 18. Accordingly, in order to insert rigid insert 14, it is necessary to first orient the rigid insert 14 in a first position wherein the depth of the rigid insert 14 is allowed to pass through the width of first portion of receiving portion 18. Once the rigid insert 14 has been substantially inserted into the receiving portion 18, it may then be turned and/or rotated to its ultimate desired orientation. It will be recognized that this process may simply be reversed in order to extract the rigid insert 14. It will further be recognized that this feature of the present invention may similarly be achieved by any number of variations to the geometries described herein. In one embodiment, the receiving portion 18 is comprised of a flexible material, such as the previously described spandex, to accommodate this insertion and extraction process. This process requires a sufficient level of user input to insert and extract the rigid insert 14 and thus reduces the risk of the rigid insert 14 becoming involuntarily dislodged.

In another embodiment, a rigid compartment 14 may be sized so that it requires insertion at an angle obtuse to a planar surface of an aperture of the receiving portion 18. The rigid compartment 14 may be sized so that it does not mate with the receiving portion 18 unless it is first directed toward the receiving portion at an obtuse angle $\alpha$ and a user either rotates or applies torsion to the rigid compartment in order to insert the entirety of the compartment 14 into the receiving portion 18.

In another embodiment, the rigid insert 14 may be comprised of a substantially rigid material that is sufficient to prevent or mitigate the risk of damage to components housed within due to impact or compression forces, yet is still somewhat deformable under torsion. One of skill in the art will recognize various materials, including, but not limited to, rubbers and wireframe materials that may be suitable for this purpose. The use of these materials may allow for the construction of a rigid insert 14 that is larger than at least an entrance or aperture of the receiving portion 18. Such a rigid compartment may still be inserted into the receiving portion 18 by deforming the insert 14 under torsion, inserting the insert 14, and allowing it to reform to an original shape due to its own elastic forces.

In one embodiment, the rigid insert 14 may be comprised of two or more independent pieces which, when inserted sequentially, combine to form a single rigid insert 14 or housing. For example, one or more of a top, sides, and back portions of a insert 14 may be inserted into receiving compartments to ultimately form a single compartment within which items may be housed.

In another embodiment, a rigid insert 14 may be securely held within a soft luggage unit 10 by a rigid or semi rigid structure(s) surrounding an opening of the receiving portion 18. For example, an opening of a receiving portion 18 may comprise a pliable lip or perimeter edge 8 which requires at least some reformation by a user in order to insert a rigid insert 14. Once a rigid insert 14 is inserted into a receiving portion 18, the pliable lip or edge may provide sufficient restraint to prevent or reduce the risk of the rigid insert 14 becoming involuntarily dislodged. Additionally, a lip or perimeter edge 8 of a receiving portion 18 may comprise a buckle or fastener which allows for the lip or perimeter 8 edge to be expanded, the rigid insert 14 inserted, and the lip or perimeter 8 edge to be subsequently contracted and re-fastened so as to prevent or minimize the risk of loss of a rigid insert 14. One of skill in the art will recognize various fasteners that may be utilized in this embodiment, including, but not limited to, snaps, buckles, Velcro, elastic draw strings, laces, etc.

One of skill in the art will further recognize various different methods for securing the removable rigid insert 14. Rigid insert 14 may be secured within the bag 10 by a zipper or zippers, magnetic fastener(s), Velcro®, and various other means that allow for selective application and removal of the rigid compartment 14. For example, a zipper may be employed to secure at least part or a whole of the circumference of a rigid insert 14 to an aperture of the receiving portion 18. In one embodiment, the rigid compartment 14 may have Velcro portions which are received by corresponding Velcro portions within the receiving portion 18. In another embodiment, the compartment 14 may contain any number of magnetic portions, or be comprised of a magnetic material, which attached to corresponding magnetic portions of the receiving portion 18. One of skill in the art will recognize that these fastening means may be used either in addition to or in place of various other embodiments.

Although FIGS. 1-3 depict a single rigid insert 14 and a single receiving portion 18, it will be recognized that any number of additional rigid compartment and receiving portions of similar design and construction may be included in a soft luggage piece 10.

Figure 4:
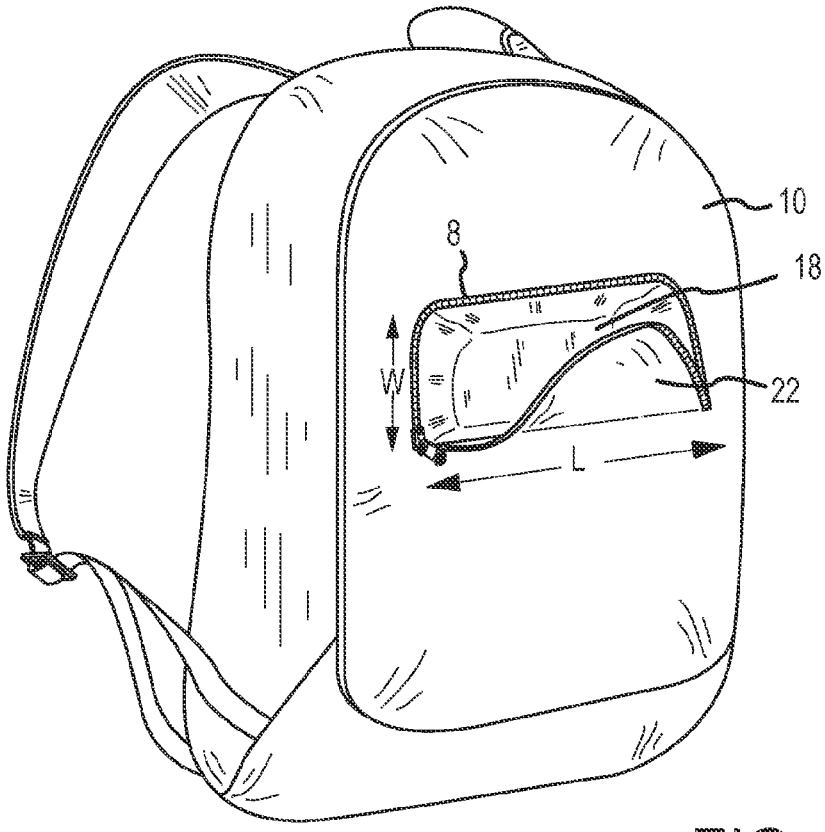
FIG. 4 is a perspective view of a luggage unit with a substantially rigid removable compartment according to another embodiment of the present invention.

Referring now to FIG. 4, alternative embodiments of the present invention are shown wherein a rigid insert 14 may be disposed within different luggage units. These additional luggage units may comprise backpacks, shoulder bags, or specialty bags such as ski and snowboard bags. As one of skill in the art will recognize, the precise location of the rigid insert 14 is not critical to the present invention. While it is sometimes desirable to provide a rigid insert 14 that is accessible from the exterior of the luggage unit 10, the disclosed device also contemplates the same or similar rigid portion 14 that is accessible from an interior portion or pocket of the luggage unit 10.

Figure 5:
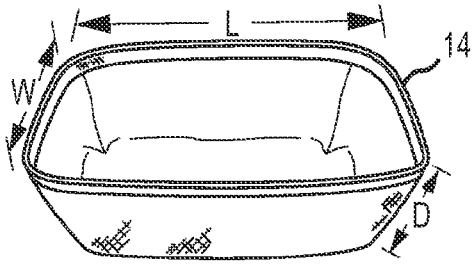
FIG. 5 is a perspective view of a luggage unit with a substantially rigid removable compartment according to yet another embodiment of the present invention.

FIG. 5 depicts a detailed view of a substantially rigid insert 14 according to one embodiment of the present invention. The insert 14 comprises a length L, a width W, and a depth D. The insert is sized so as to fit within a receiving portion of one or more luggage items. However, as shown and described herein, at least one of the width and/or length of the insert 14 is sized such that it is larger than a corresponding width and/or length of a perimeter edge 8 of the receiving portion 18. Accordingly, specific manipulation is required to both insert and remove the insert from the receiving portion, providing for secure containment of the insert 14 and thereby reducing or minimizing risk of loss of the same.

Figure 6:
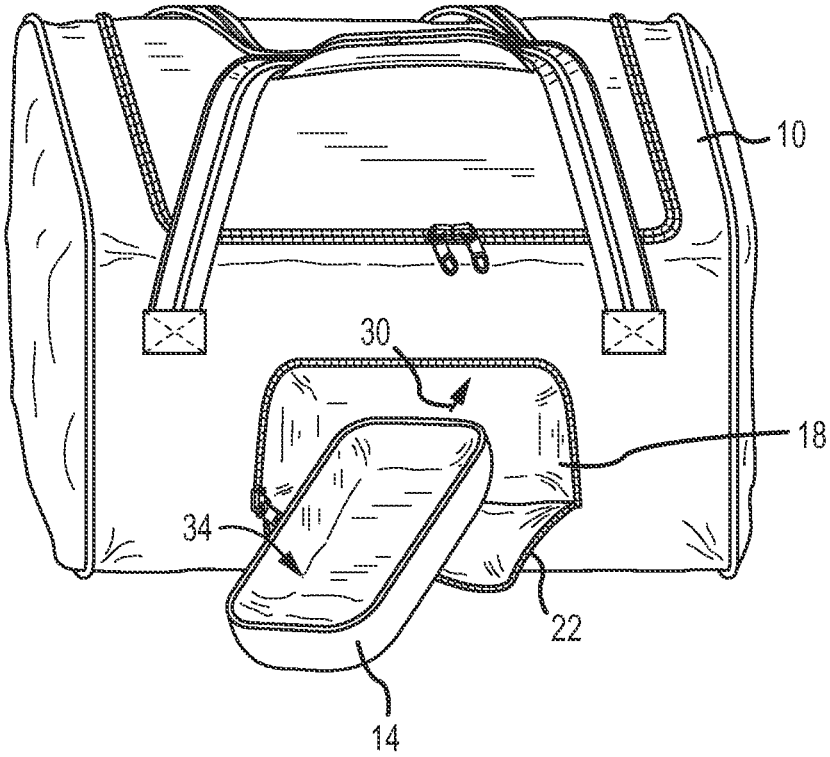

Referring now to FIG. 6, an embodiment is depicted wherein a rigid insert 14 requires specific operation by a user in order to be disposed within a receiving portion 18. Rigid insert 14 is preferably inserted into receiving portion 18 by applying both a linear force 30 and a rotational force 34. As previously described, a rigid insert 14 may be dimensioned so that at least some dimensions of the rigid insert 14 are larger than corresponding dimensions of first portion or a perimeter edge 8 of receiving portion 18. Accordingly, rigid insert 14 must first be positioned so that, for example, its height is to pass through a width of receiving portion 18 in order to dispose the insert within the receiving portion Rigid insert 14 may also need to be positioned at an angle obtuse to a planar surface of receiving portion 18. In order to insert the rigid insert 14, rotational force 34 may be applied in addition to linear force 30. In one embodiment, once a rigid insert 14 is inserted and properly aligned, at least one of its dimensions will be greater than a corresponding dimension of a first part or perimeter edge of a receiving portion 18. In this manner, risk of the rigid compartment 14 becoming involuntarily dislodged and/or lost is reduced.

Figure 7:
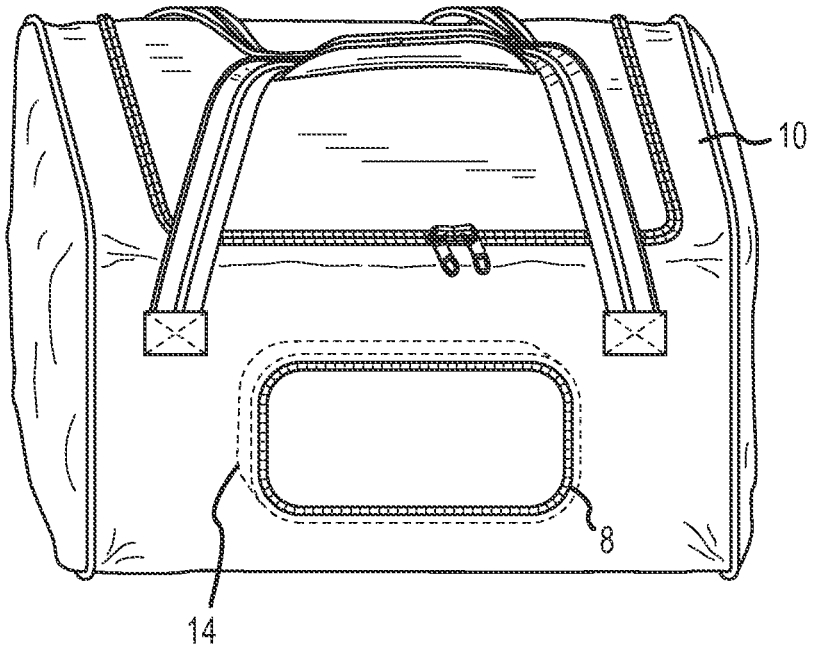

Referring now to FIG. 7, a perspective view of one embodiment of the present invention is shown wherein a rigid compartment 14 is disposed within a receiving portion 18. As shown, the width and length of the insert 14 are greater than the width and length of the perimeter edge 8 of the receiving portion 18. The receiving portion 18 comprises a stretchable, collapsible material which acts to bias the insert 14 such that a top portion of the insert 14 is in communication with a bottom or interior portion of the perimeter edge 8. Thus, the insert 14 is secured within the receiving portion 18 until an appropriate combination of user applied forces and/or rotation is employed to intentionally remove the insert.

While various embodiments the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A carrying bag with removable accessory case adapted for storing fragile articles, comprising:

an enclosure defined by at least a bottom portion and opposing side walls;

a compartment comprising a perimeter edge formed in a side wall of the carrying bag and an elastically deformable material generally disposed interior of the perimeter edge and within the enclosure for receiving and stabilizing a substantially rigid case;

the substantially rigid case selectively removable from the carrying bag and defined by at least a plurality of sidewalls to provide a protective space which is adapted to store the fragile article and wherein the substantially rigid case comprises at least one dimension that is larger than a corresponding dimension of a perimeter opening of said collapsible, stretchable receiving portion;

the substantially rigid case comprising at least one of a width and a length that is greater than a corresponding width or length of the perimeter edge, and wherein the case is biased against the perimeter edge by the elastically deformable material;

wherein the substantially rigid case is positioned within the receiving portion by inserting the rigid case at an obtuse angle with respect to a plane of said perimeter opening, and exerting a force on the substantially rigid case; and a substantially rigid cover for selectively closing the receiving portion and the substantially rigid case.

2. The carrying bag of claim 1, wherein said substantially rigid case is biased against a lower edge of said perimeter opening by said collapsible, stretchable receiving portion to prevent inadvertent removal.

3. The carrying bag of claim 1, wherein said receiving portion is only accessible from the exterior of the carrying bag.

4. The carrying bag of claim 1, wherein the substantially rigid case has a volume no greater than 25% of the volume of the carrying bag.

5. A carrying bag for storing articles in two distinct compartments, comprising:

a first enclosure defined by at least a bottom portion and a plurality of side walls;

a second enclosure defined by a flexible, collapsible receiving portion which is disposed within the confines of the first enclosure and includes a perimeter opening formed through at least one of the plurality of side walls, the perimeter opening comprising an edge having a defined width and a defined length;

a substantially rigid insert that is selectively removable from the second enclosure wherein the rigid insert has a width greater than said defined width of said edge of said perimeter opening, and a length longer than the defined length of said edge of said perimeter opening;

wherein the substantially rigid insert is positioned within the flexible receiving portion by positioning the rigid insert at an obtuse angle with respect to the plane of the perimeter opening, and said rigid insert is retained within said collapsible retaining portion by engaging a lower surface of the edge of the perimeter opening; and wherein the second enclosure comprises a rigid hinged cover for selectively closing the second enclosure and the substantially rigid insert when the substantially rigid insert is provided within the second enclosure.

6. The carrying bag of claim 5, wherein said flexible collapsible receiving portion is comprised of a stretchable material which biases the rigid insert against the lower surface of said edge of the perimeter opening.

7. The carrying bag of claim 5, wherein said substantially rigid insert comprises a generally rectilinear shape having at least five walls which define a hollow space and adapted for storing fragile items.

* * * * *